US008347866B2

(12) United States Patent
Meyer et al.

(10) Patent No.: US 8,347,866 B2
(45) Date of Patent: Jan. 8, 2013

(54) FUEL CONTROL SYSTEM AND METHOD FOR MORE ACCURATE RESPONSE TO FEEDBACK FROM AN EXHAUST SYSTEM WITH AN AIR/FUEL EQUIVALENCE RATIO OFFSET

(75) Inventors: Jason Meyer, Dayton, OH (US); Shawn W. Midlam-Mohler, Columbus, OH (US); Kenneth P. Dudek, Rochester Hills, MI (US); Stephen Yurkovich, Columbus, OH (US); Yann G. Guezennec, Upper Arlington, OH (US)

(73) Assignee: GM Global Technology Operations LLC

( * ) Notice: Subject to any disclaimer, the term of this patent is extended or adjusted under 35 U.S.C. 154(b) by 393 days.

(21) Appl. No.: 12/725,913

(22) Filed: Mar. 17, 2010

(65) Prior Publication Data

US 2011/0073089 A1 Mar. 31, 2011

Related U.S. Application Data

(60) Provisional application No. 61/246,685, filed on Sep. 29, 2009.

(51) Int. Cl.
*F02D 41/00* (2006.01)

(52) U.S. Cl. ..... 123/696; 123/703

(58) Field of Classification Search ..... 123/672, 123/673, 688, 693, 696, 703; 701/103–105, 701/109; 60/285, 286, 274, 276
See application file for complete search history.

(56) References Cited

U.S. PATENT DOCUMENTS

| | | | | |
|---|---|---|---|---|
| 4,170,969 | A * | 10/1979 | Asano | 123/680 |
| 5,467,593 | A * | 11/1995 | Vincent et al. | 60/274 |
| 5,511,377 | A * | 4/1996 | Kotwicki | 60/274 |
| 6,470,674 | B1 * | 10/2002 | Yamaguchi et al. | 60/277 |
| 7,000,379 | B2 * | 2/2006 | Makki et al. | 60/285 |
| 2010/0218485 | A1 * | 9/2010 | Fujiwara et al. | 60/276 |

FOREIGN PATENT DOCUMENTS

JP 2009-108757 * 5/2009

* cited by examiner

*Primary Examiner* — Hai Huynh

(57) ABSTRACT

An engine control system includes a saturation determination module, an adjustment factor generation module, and a fuel control module. The saturation determination module determines when a first exhaust gas oxygen (EGO) sensor is saturated, wherein the first EGO sensor is located upstream from a catalyst. The adjustment factor generation module generates an adjustment factor for an integral gain of a fuel control module when the first EGO sensor is saturated. The fuel control module adjusts a fuel command for an engine based on differences between expected and measured amounts of oxygen in exhaust gas produced by the engine, a proportional gain, the integral gain, and the integral gain adjustment factor.

30 Claims, 5 Drawing Sheets

FUEL CONTROL SYSTEM AND METHOD FOR MORE ACCURATE RESPONSE TO FEEDBACK FROM AN EXHAUST SYSTEM WITH AN AIR/FUEL EQUIVALENCE RATIO OFFSET

CROSS-REFERENCE TO RELATED APPLICATIONS

This application claims the benefit of U.S. Provisional Application No. 61/246,685, filed on Sep. 29, 2009. The disclosure of the above application is incorporated herein by reference in its entirety.

FIELD

The present disclosure relates to internal combustion engines, and more particularly to a fuel control system and method for improved response to feedback from exhaust gas oxygen (EGO) sensors in an exhaust system with an air/fuel equivalence ratio (EQR) offset.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air/fuel (A/F) mixture within cylinders to drive pistons and generate drive torque. A ratio of air to fuel in the A/F mixture may be referred to as an A/F ratio. The A/F ratio may be regulated by controlling at least one of a throttle and a fuel control system. The A/F ratio, however, may also be regulated by controlling other engine components (e.g., an exhaust gas recirculation, or EGR, system). For example, the A/F ratio may be regulated to control torque output of the engine and/or to control emissions produced by the engine.

The fuel control system may include an inner feedback loop and an outer feedback loop. More specifically, the inner feedback loop may use data from an exhaust gas oxygen (EGO) sensor located upstream from a catalytic converter in an exhaust system of the engine system (i.e., a pre-catalyst EGO sensor). The inner feedback loop may use the data from the pre-catalyst EGO sensor to control a desired amount of fuel supplied to the engine (i.e., a fuel command).

For example, the inner feedback loop may decrease the fuel command when the pre-catalyst EGO sensor senses a rich A/F ratio in exhaust gas produced by the engine (i.e., non-burnt fuel vapor). Alternatively, for example, the inner feedback loop may increase the fuel command when the pre-catalyst EGO sensor senses a lean A/F ratio in the exhaust gas (i.e., excess oxygen). In other words, the inner feedback loop may maintain the A/F ratio at or near an ideal A/F ratio (e.g., stoichiometry, or 14.7:1), thus increasing the fuel economy of the engine and/or decreasing emissions produced by the engine.

Specifically, the inner feedback loop may perform proportional-integral (PI) control to correct the fuel command. Moreover, the fuel command may be further corrected based on a short term fuel trim or a long term fuel trim. For example, the short term fuel trim may correct the fuel command by changing gains of the PI control. Additionally, for example, the long term fuel trim may correct the fuel command when the short term fuel trim is unable to fully correct the fuel command within a desired time period.

The outer feedback loop, on the other hand, may use information from an EGO sensor arranged after the catalytic converter (i.e., a post-catalyst EGO sensor). The outer feedback loop may use data from the post-catalyst EGO sensor to correct (i.e., calibrate) an unexpected reading from the pre-catalyst EGO sensor, the post-catalyst EGO sensor, and/or the catalytic converter. For example, the outer feedback loop may use the data from the post-catalyst EGO sensor to maintain the post-catalyst EGO sensor at a desired voltage level. In other words, the outer feedback loop may maintain a desired amount of oxygen stored in the catalytic converter, thus improving the performance of the exhaust system. Additionally, the outer feedback loop may control the inner feedback loop by changing thresholds used by the inner feedback loop in determining whether the A/F ratio is rich or lean.

Exhaust gas composition (e.g., A/F ratio) may affect the behavior of the EGO sensors, thereby affecting accuracy of the EGO sensor values. As a result, fuel control systems have been designed to operate based on values that are different than expected. For example, fuel control systems have been designed to operate "asymmetrically." In other words, for example, the error response of the fuel control system to a lean A/F ratio may be different than the error response of the fuel control system to a rich A/F ratio.

The asymmetry is typically designed as a function of engine operating parameters. Specifically, the asymmetry is a function of the exhaust gas composition, and the exhaust gas composition is a function of the engine operating parameters. The asymmetry is achieved indirectly by adjusting the gains and the thresholds of the inner feedback loop, requiring numerous tests at various engine operating conditions. Moreover, this extensive calibration is required for each powertrain and vehicle class and does not easily accommodate other technologies, including, but not limited to, variable valve timing and lift.

SUMMARY

An engine control system includes a saturation determination module, an adjustment factor generation module, and a fuel control module. The saturation determination module determines when a first exhaust gas oxygen (EGO) sensor is saturated, wherein the first EGO sensor is located upstream from a catalyst. The adjustment factor generation module generates an adjustment factor for an integral gain of a fuel control module when the first EGO sensor is saturated. The fuel control module adjusts a fuel command for an engine based on differences between expected and measured amounts of oxygen in exhaust gas produced by the engine, a proportional gain, the integral gain, and the integral gain adjustment factor.

A method includes determining when a first exhaust gas oxygen (EGO) sensor is saturated, wherein the first EGO sensor is located upstream from a catalyst, generating an adjustment factor for an integral gain when the first EGO sensor is saturated, and adjusting a fuel command for an engine based on differences between expected and measured amounts of oxygen in exhaust gas produced by the engine, a proportional gain, the integral gain, and the integral gain adjustment factor.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1A:
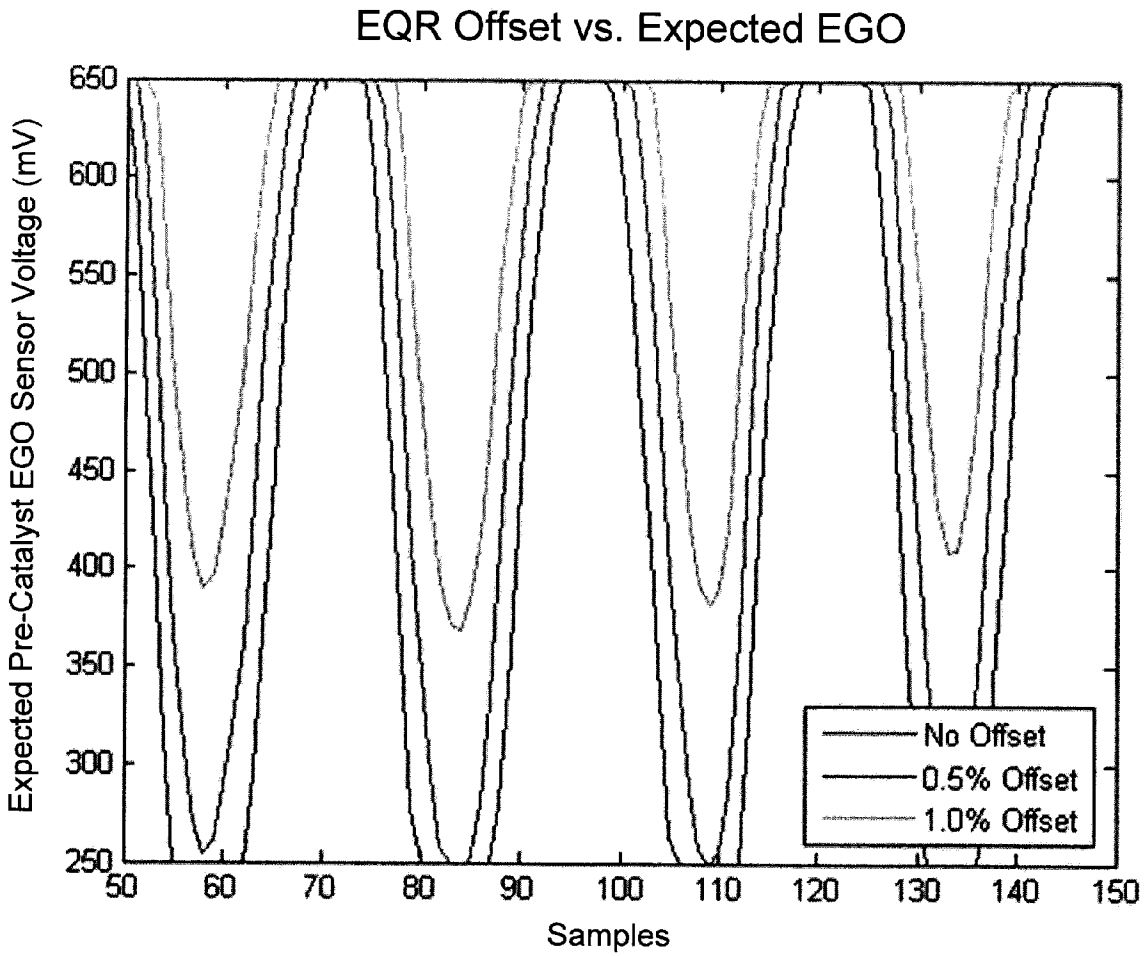
FIG. 1A is a graph illustrating effects of an air/fuel equivalence ratio (EQR) offset on expected pre-catalyst exhaust gas oxygen (EGO) sensor measurements.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A desired amount of fuel to be supplied to an engine (i.e., a fuel command) may be adjusted based on feedback from an exhaust gas oxygen (EGO) sensor upstream from a catalytic converter (i.e., a pre-catalyst EGO sensor). For example, the fuel command may include control signals for a plurality of fuel injectors corresponding to the desired amount of fuel. The feedback may be a difference (i.e., error) between expected and actual amounts of oxygen in exhaust gas produced by the engine. More specifically, the feedback may be a voltage error ($V_{err}$) indicating a difference between expected voltage measurements from the pre-catalyst EGO sensor ($V_{exp}$), which is based on the fuel command, and actual voltage measurements from the pre-catalyst EGO sensor ($V_{meas}$).

A control module may perform proportional-integral (PI) control of the fuel command based on the voltage error $V_{err}$. Rather, the fuel command may be adjusted using a proportional correction and an integral correction, both of which may be derived from the voltage error $V_{err}$. For example, the PI control may adjust the fuel command based on a weighted sum of the proportional correction and the integral correction.

More specifically, the proportional correction may include a product of the voltage error $V_{err}$ and a proportional gain (P). The proportional correction may provide faster correction to the fuel command in response to changes in the voltage error $V_{err}$. The integral correction, on the other hand, may include an integral of a product of the voltage error $V_{err}$ and an integral gain (I). The integral correction may improve accuracy of the fuel command by decreasing steady-state error.

An EGO sensor may include an output voltage proportional to an air/fuel equivalence ratio (EQR) for a small range of EQR, hereinafter referred to as the "proportional EQR range". The EQR may be defined as a ratio of a stoichiometric air/fuel (A/F) ratio (e.g., 14.7:1) to an actual A/F ratio. Thus, for example only, an actual A/F ratio of 12.25:1 (richer than stoichiometry) may correspond to an EQR of 1.20. The proportional EQR range may be centered at stoichiometry (i.e., an EQR of 1.00). Outside of the proportional EQR range, however, the output voltage of the EGO sensor may have a weaker sensitivity to the oxygen concentration and thus the A/F ratio. Engine control systems, therefore, may artificially saturate the EGO voltage inside the proportional EQR range.

In order to meet emissions targets the commanded EQR signal (i.e., the fuel command) may not have a stoichiometric mean. Moreover, the regulation of the oxygen stored in a catalytic converter may require a non-stoichiometric EQR offset. The expected output voltage of the pre-catalyst EGO sensor ($V_{exp}$), however, changes as a function of the commanded EQR signal. The mean expected output voltage $V_{mean}$, therefore, may change as a function of the EQR offset.

Referring now to FIG. 1A, for example, the artificial saturation limits may be 250 mV for the lower voltage bound ($V_{lower}$) and 650 mV for the upper voltage bound ($V_{upper}$). Furthermore, the EGO sensor may read stoichiometry at 450 mV. The three waveforms represent the expected EGO sensor voltage for a dither signal with an amplitude of 1.5% (0.015 EQR) and a dither period of 25 samples, and three different EQR offsets (no offset, +0.5% offset, and +1.0% offset). As shown, the expected EGO voltage spends more time at the upper saturation bound $V_{upper}$ as the EQR offset increases. As a result, the mean expected voltage $V_{exp}$ varies.

A disturbance, however, may not be rejected until a total control action taken in response to the disturbance equals the magnitude of the disturbance. Moreover, large disturbances may cause the measured pre-catalyst EGO voltage $V_{meas}$ to exceed the voltage bounds $V_{lower}$ or $V_{upper}$. As long as the EGO voltage remains saturated, however, the average of the voltage error $V_{err}$ may be approximated as a difference between the mean expected voltage $V_{mean}$ and the appropriate voltage bound ($V_{upper}$ for rich A/F errors and $V_{lower}$ for lean A/F errors). For sufficiently large disturbances, an amount of time required to remove the disturbance may be approximately inversely proportional to a product of the integral gain I and the mean expected voltage $V_{mean}$.

Figure 1B:
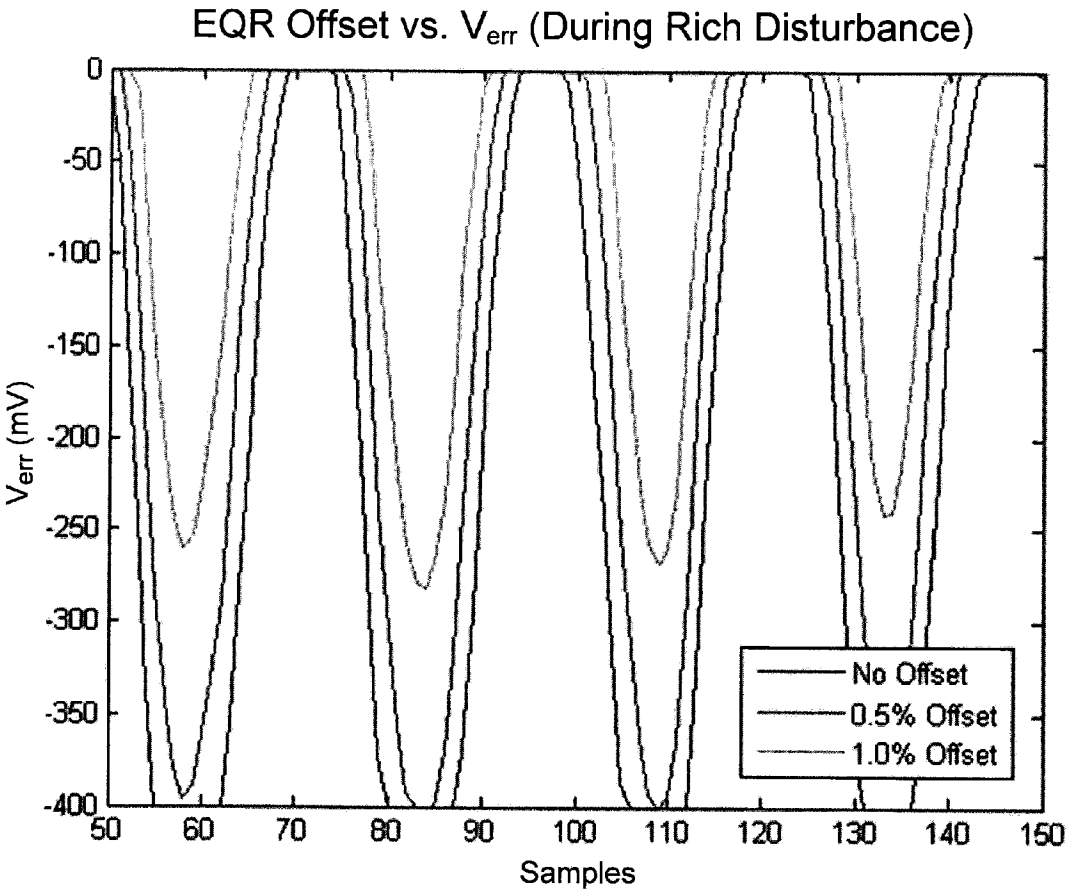
FIG. 1B is a graph illustrating effects of an EQR offset on a difference between expected and actual pre-catalyst EGO sensor measurements during a rich disturbance.

Referring now to FIG. 1B, for example, the voltage error $V_{err}$ due to a rich disturbance that is sufficiently large to saturate the measured voltage $V_{meas}$ is shown. In this example, the average magnitude of the voltage error $V_{err}$ during a dither cycle (25 samples) decreases as the EQR offset increases. Thus, for a constant integral gain I, an amount of time required to reject the disturbance may increase as the EQR offset increases.

Typical engine control systems, therefore, may either limit EQR offsets or not use EQR offsets. Specifically, typical engine control systems may limit or not use EQR offsets to reduce variation in the mean expected voltage $V_{mean}$. Limiting or not using EQR offsets, however, may inhibit the inner loop from tracking the expected voltage $V_{exp}$ and/or prevent the inner loop from achieving the desired (outer loop) EQR offset. Alternatively, typical engine control systems may use EQR offsets, but (as previously described) the PI control may fail to correct some disturbances. In other words, typical engine control systems that use EQR offsets may include decreased large-scale disturbance rejection properties. Moreover, the integrator in the outer loop may command a larger EQR offset without recognizing the desired EQR effect (i.e., integrator windup).

Therefore, a system and method is presented that performs PI control of the fuel command using an integral gain adjustment factor ($I_{af}$) for the integral gain I. More specifically, the integral gain adjustment factor $I_{af}$ may adjust the integral gain I to maintain constant large-scale disturbance rejection performance. Accordingly, the product between the integral gain I and the difference between the appropriate voltage bound ($V_{upper}$ for rich A/F errors and $V_{lower}$ for lean A/F errors) and the mean expected voltage $V_{mean}$ is held constant.

In other words, the integral gain adjustment factor $I_{af}$ modifies the integral gain I to compensate for changes in the mean expected voltage $V_{mean}$ resulting from an EQR offset. The integral gain adjustment factor $I_{af}$ may be applied when the voltage error $V_{err}$ is saturated for longer than a predetermined period (e.g., the dither period). Moreover, the integral gain adjustment factor $I_{af}$ may be filtered. More specifically, the filter may be reset (i.e., set to one) when a polarity of the voltage error $V_{err}$ changes or when the voltage error $V_{err}$ is no longer saturated.

Figure 2:
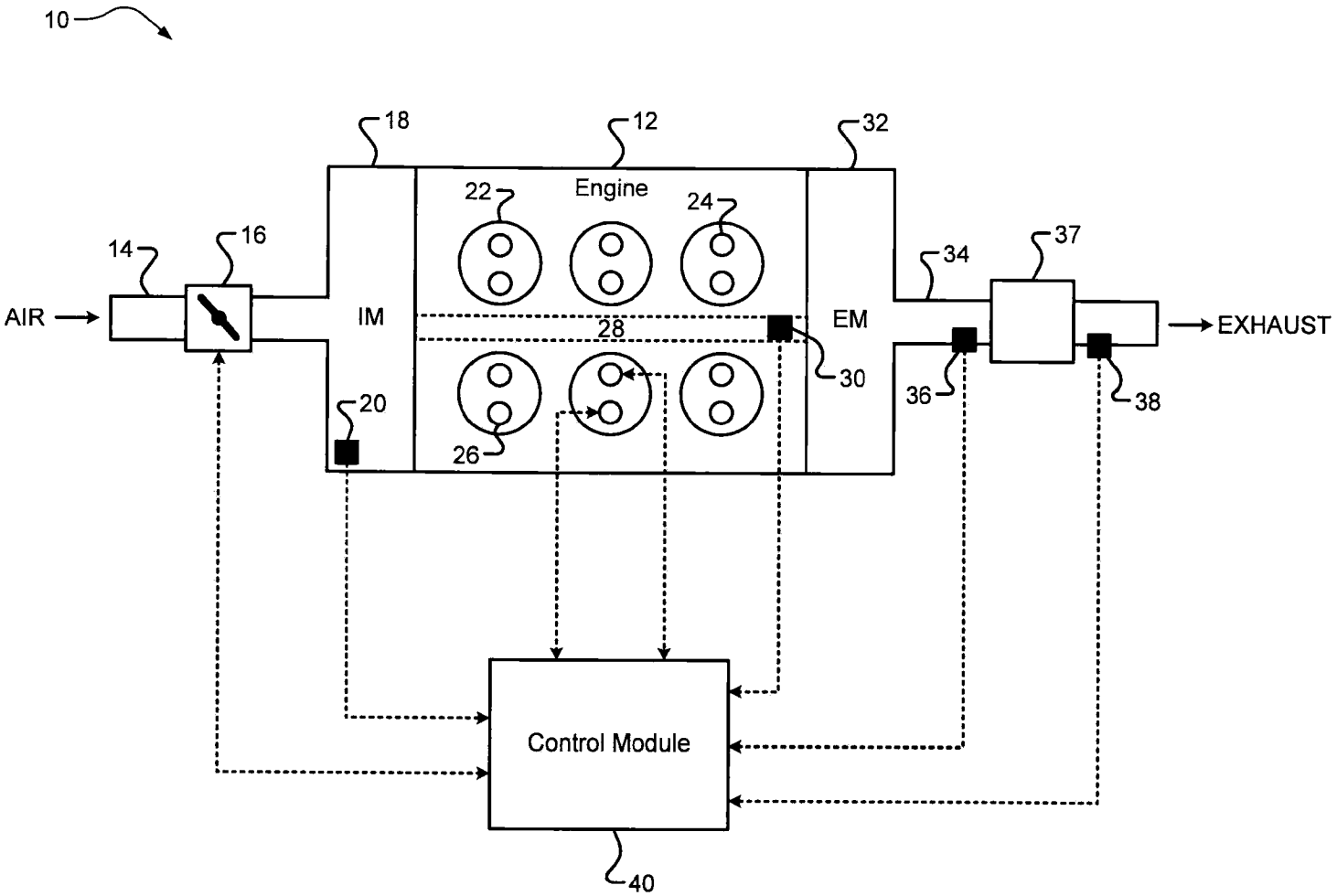
FIG. 2 is a functional block diagram of an exemplary engine system according to the present disclosure.

Referring now to FIG. 2, an engine system 10 includes an engine 12. Air is drawn into an intake manifold 18 through an inlet 14 that may be regulated by a throttle 16. Air pressure in the intake manifold 18 may be measured by a manifold pressure (MAP) sensor 20. The air in the intake manifold may be distributed through intake valves (not shown) into a plurality of cylinders 22. While six cylinders are shown, it can be appreciated that other numbers of cylinders may be implemented.

Fuel injectors 24 inject fuel into the cylinders 22 to create an air/fuel (A/F) mixture. While fuel injectors 24 are implemented in each of the cylinders 22 (i.e. direct fuel injection), it can be the fuel injectors 24 may inject fuel into one or more intake ports of the cylinders 22 (i.e. port fuel injection). The A/F mixture in the cylinders 22 is compressed by pistons (not shown) and ignited by spark plugs 26. The combustion of the A/F mixture drives the pistons (not shown), which rotatably turns a crankshaft 28 generating drive torque. An engine speed sensor 30 may measure a rotational speed of the crankshaft 28 (e.g., in revolutions per minute, or RPM).

Exhaust gas resulting from the combustion is vented from the cylinders 22 through exhaust valves (not shown) and into an exhaust manifold 32. An exhaust system 34 treats the exhaust gas to reduce emissions and then expels the exhaust gas from the engine 12. A first exhaust gas oxygen (EGO) sensor 36 generates a first voltage that indicates an amount of oxygen in the exhaust gas upstream from (i.e., before) a catalytic converter 37. The first EGO sensor 36 may hereinafter be referred to as a "pre-catalyst EGO sensor." The catalytic converter 37 treats the exhaust gas to reduce emissions. A second EGO sensor 38 generates a second voltage that indicates on an amount of oxygen in the exhaust gas downstream from (i.e. after) the catalytic converter 37. The second EGO sensor 38 may hereinafter be referred to as a "post-catalyst EGO sensor."

For example only, the EGO sensors 36, 38 may include, but are not limited to, switching EGO sensors or universal EGO (UEGO) sensors. The switching EGO sensors generate an EGO signal in units of voltage and switch the EGO signal to a low or a high voltage when the oxygen concentration level is lean or rich, respectively. The UEGO sensors generate an EGO signal in units of EQR and eliminate the switching between lean and rich oxygen concentration levels of the switching EGO sensors.

The control module 40 regulates operation of the engine system 10. More specifically, the control module 40 may control at least one of air, fuel, and spark supplied to the engine 12. For example, the control module 40 may regulate airflow into the engine 12 by controlling the throttle, fuel supplied to the engine 12 by controlling the fuel injectors 24, and spark supplied to the engine 12 by controlling the spark plugs 26. The control module 40 may also receive the first and second voltages from the pre-catalyst EGO sensor 36 and the post-catalyst EGO sensor 38, respectively.

The control module 40 may implement the system and/or method of the present disclosure. More specifically, the control module 40 may generate the integral gain adjustment factor $I_{af}$ based on the EQR offset (and thus in turn based on the mean expected voltage $V_{mean}$). The control module 40 may then adjust the integral gain I using the integral gain adjustment factor. Finally, the control module 40 may then perform PI control to adjust the fuel command to the engine 12 using the proportional gain P and the adjusted integral gain I.

Figure 3:
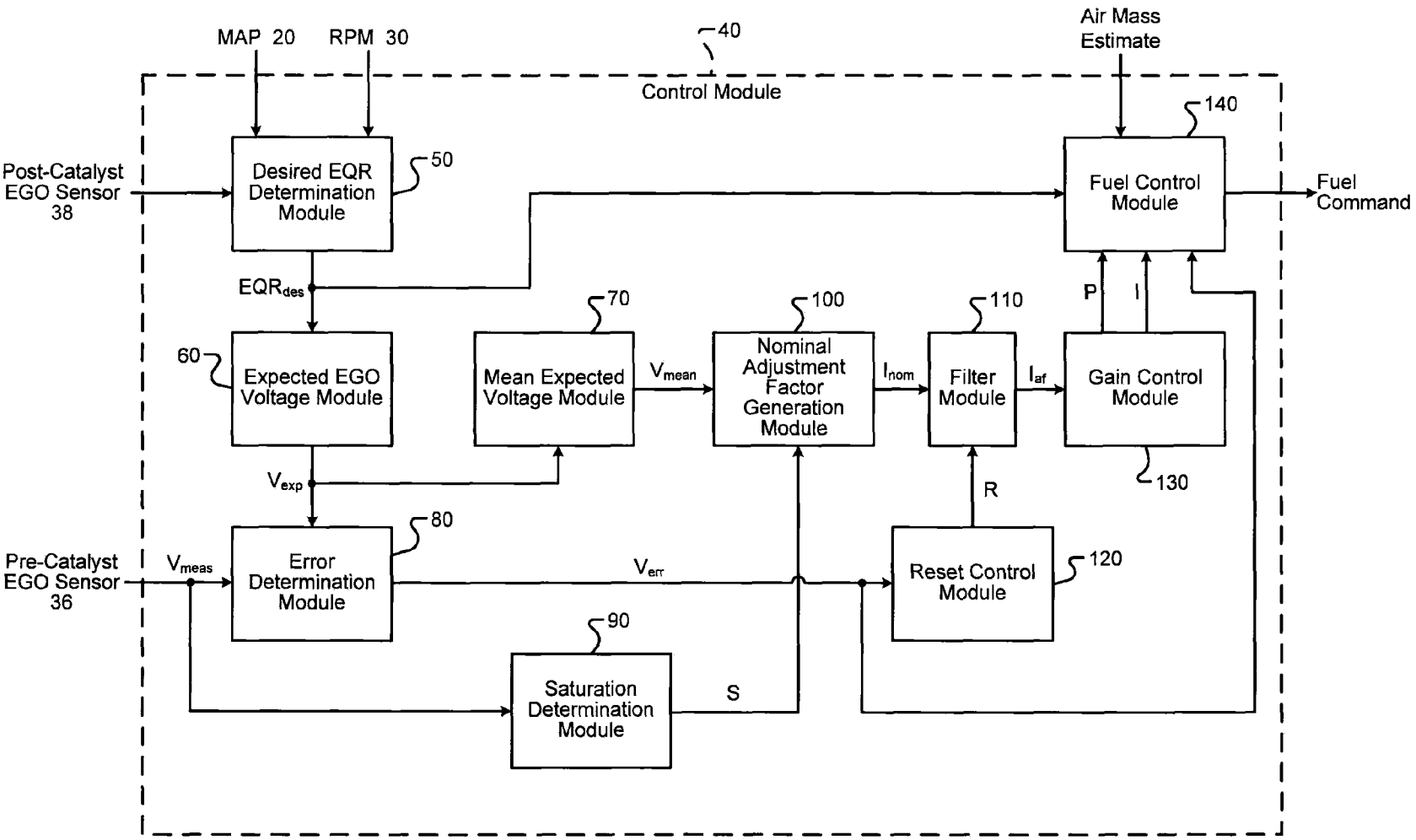
FIG. 3 is a functional block diagram of an exemplary control module according to the present disclosure.

Referring now to FIG. 3, the control module 40 is shown in more detail. The control module 40 may include a desired EQR determination module 50, an expected EGO voltage module 60, a mean expected voltage module 70, an error determination module 80, a saturation determination module 90, a nominal adjustment factor generation module 100, a filter module 110, a reset control module 120, a gain control module 130, and a fuel control module 140. In one embodiment, the nominal adjustment factor generation module 100 and the filter module 110 may be collectively referred to as "an adjustment factor generation module."

The desired EQR determination module 50 determines a desired EQR ($EQR_{des}$) based on measurements from the MAP sensor 20, the engine RPM sensor 30, and the post-catalyst EGO sensor 38. For example, the desired EQR signal $EQR_{des}$ may be a sinusoidal dither signal with a variable EQR offset.

The expected EGO voltage module 60 predicts the response of the pre-catalyst EGO sensor 36 based on the desired EQR $EQR_{des}$. Accordingly, the expected EGO voltage module 60 generates the expected voltage $V_{exp}$ of the pre-catalyst EGO sensor 36.

The mean expected voltage module 70 predicts the mean expected voltage $V_{mean}$ over a dither period based on the expected voltage $V_{exp}$ from the expected EGO voltage module 60.

The error determination module 80 receives the measured voltage $V_{meas}$ from the pre-catalyst EGO sensor 36 and the expected voltage $V_{exp}$ from the expected EGO voltage module 60. The error determination module 80 determines the voltage error $V_{err}$ based on the differences between the measured voltage $V_{meas}$ and the expected voltage $V_{exp}$ corresponding to the desired EQR $EQR_{des}$. In other words, the voltage error $V_{err}$ indicates differences between measured and expected amounts of oxygen in exhaust gas produced by the engine 12.

The saturation determination module 90 receives the measured voltage $V_{meas}$. The saturation determination module 60 determines whether voltage $V_{meas}$ is saturated. More specifically, the saturation determination module 60 determines that the voltage $V_{meas}$ is saturated when the voltage $V_{meas}$ is greater than the upper saturation bound $V_{upper}$ for longer than the dither period ($T_d$). The saturation determination module 60 may also determine that the voltage $V_{meas}$ is saturated when the voltage $V_{meas}$ is less than the lower saturation bound $V_{lower}$ longer than the dither period $T_d$. For example, the upper saturation bound $V_{upper}$ may be a higher voltage than the lower saturation bound $V_{lower}$. The saturation determination module 60 may generate a saturation signal (S) when the voltage $V_{meas}$ is saturated.

The nominal adjustment factor generation module 100 receives the mean expected voltage $V_{mean}$ from the mean expected voltage module 130 and the saturation signal S from the saturation determination module 90. The nominal adjustment factor generation module 70 generates a nominal integral gain adjustment factor $I_{nom}$ when the voltage $V_{meas}$ is saturated (i.e., when the saturation signal S is received). In other words, when the voltage $V_{meas}$ is not saturated the nominal integral gain adjustment factor $I_{nom}$ may be equal to one.

For rich EQR offsets ($V_{meas}>V_{exp}$), the nominal integral gain adjustment factor $I_{nom}$ may be generated as follows:

$$I_{nom} = \frac{V_{upper} - V_{lower}}{2(V_{upper} - V_{mean})}, \quad (1)$$

where $V_{upper}$, $V_{lower}$, and $V_{mean}$ represent the upper and lower saturation bounds of the measured voltage $V_{meas}$ and the mean expected voltage $V_{mean}$, respectively.

For lean EQR offsets ($V_{meas}<V_{exp}$), the nominal integral gain adjustment factor $I_{nom}$ may be generated as follows:

$$I_{nom} = \frac{V_{upper} - V_{lower}}{2(V_{mean} - V_{lower})}, \quad (2)$$

where $V_{upper}$, $V_{lower}$, and $V_{mean}$ represent the upper and lower saturation bounds of the measured voltage $V_{meas}$ and the mean expected voltage $V_{mean}$, respectively.

The filter module 110 filters the nominal integral gain adjustment factor $I_{nom}$ to generate the integral gain adjustment factor $I_{af}$. For example only, the filter may be a first order discrete filter. The filter module 110 may also receive a reset signal (R) from the reset control module 120. The filter module 110 may reset the integral gain adjustment factor $I_{af}$ based on the reset signal R (i.e., when the reset signal R is received). More specifically, the filter module 110 may set the integral gain adjustment factor $I_{af}$ equal to one.

The reset control module 120 receives the voltage error $V_{err}$. The reset control module 120 generates the reset signal R based on the voltage error $V_{err}$. More specifically, the reset control module 120 may generate the reset signal R when a polarity of the voltage error $V_{err}$ changes. As previously described, the reset control module 120 may send the reset signal R to the filter module 110 to reset the integral gain adjustment factor $I_{af}$.

The gain control module 130 receives the integral adjustment factor $I_{af}$. The gain control module 130 also receives the voltage $V_{err}$. The gain control module 130 generates proportional and integral gains (P and I, respectively) to be used for PI control of the fuel command by the fuel control module 140. The gain control module 130 may adjust a baseline integral gain $I_{base}$ by the adjustment factor $I_{af}$. For example, the baseline integral gain $I_{base}$ may be multiplied by the integral gain adjustment factor $I_{af}$ and the product (i.e., $I=I_{base}\times I_{af}$) may be supplied to the fuel control module 140.

The fuel control module 140 determines the fuel commend (i.e., the required fueling) to achieve the desired EQR $EQR_{des}$ given an estimate of a trapped air mass. For example only, the estimate of the trapped air mass may be based on a mass air flow (MAF) rate into the engine 12. The estimate of the trapped air mass, however, may also be determined using other sensors and/or engine operating parameters.

The fuel control module 140 also receives the proportional and integral gains P and I, respectively. The fuel control module 140 also receives the voltage error $V_{err}$. The fuel control module 140 performs PI control to adjust the fuel command based. More specifically, the fuel control module 140 may adjust the fuel command based on the proportional gain P, the integral gain I, and the voltage error $V_{err}$. In other words, the fuel control module 140 may determine a proportional correction and an integral correction.

For example, the proportional correction may be a product of the proportional gain P and the voltage error $V_{err}$. Additionally, for example, the integral correction may be an integral of a product of the integral gain I and the voltage error $V_{err}$. Thus, the fuel control module 140 may adjust the fuel command based on a weighted sum of the proportional correction and the integral correction. Additionally, for example only, the fuel command may include control signals for the fuel injectors 24. However, it can be appreciated that the fuel command may include control signals for other engine components (e.g., an EGR system).

Figure 4:
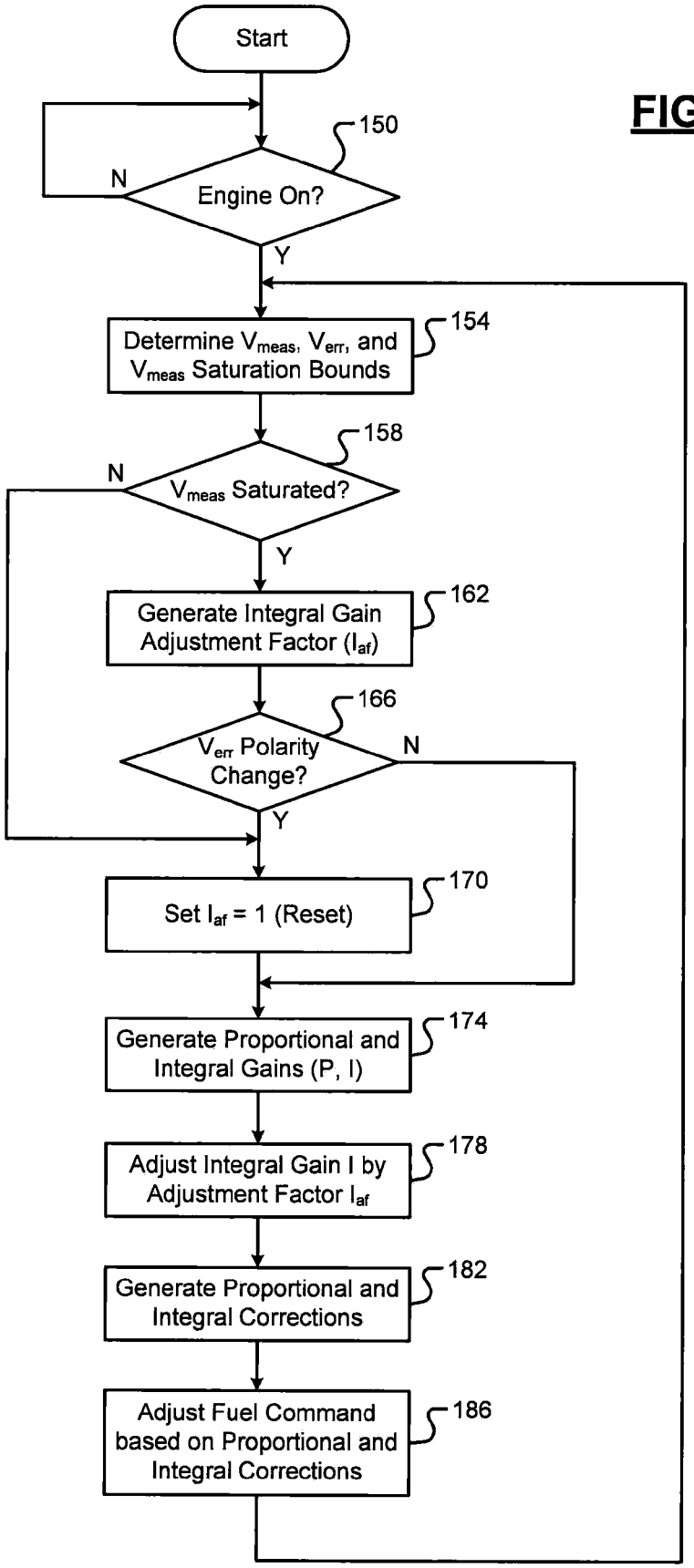
FIG. 4 is a flow diagram of an exemplary method for controlling fuel supplied to an engine according to the present disclosure.

Referring now to FIG. 4, a method for controlling fuel supplied to the engine 12 (i.e., the fuel command) begins in step 150. In step 150, the control module 40 determines whether the engine 12 is started (i.e., running). If true, control may proceed to step 154. If false, control may return to step 150.

In step 154, the control module 40 determines the measured voltage $V_{meas}$ and the corresponding upper lower saturation bounds $V_{upper}$ and $V_{lower}$, respectively, of the measured voltage $V_{meas}$. Additionally, the control module 40 may determine the voltage error $V_{err}$ indicating differences between measured and expected amounts of oxygen in exhaust gas produced by the engine 12.

In step 158, the control module 40 determines whether the measured voltage $V_{meas}$ is saturated (i.e., outside of the upper and lower saturation bounds $V_{upper}$ and $V_{lower}$, respectively). If true, control may proceed to step 162. If false, control may proceed to step 170.

In step 162, the control module 40 may generate the integral gain adjustment factor $I_{af}$. For example, the control module 40 may generate the nominal integral gain adjustment factor $I_{nom}$ and filter it to produce the integral gain adjustment factor $I_{af}$.

In step 166, the control module 40 may determine whether the polarity of the voltage error $V_{err}$ has changed. If true, the control module may proceed to step 170. If false, control may proceed to step 174.

In step 170, the control module 40 may reset the integral gain adjustment factor $I_{af}$. In other words, the control module 40 may set the integral gain adjustment factor $I_{af}$ to one, thus ignoring the nominal integral gain adjustment factor $I_{nom}$. In step 174, the control module 40 may generate the proportional gain P and the integral gain I.

In step 178, the control module 40 may adjust the integral gain I by the integral gain adjustment factor $I_{af}$. For example, the control module 40 may multiply the integral gain I by the adjustment factor $I_{af}$ (i.e., $I=I\times I_{af}$). In step 182, the control module 40 may generate the proportional correction and the integral correction. For example, the proportional correction may be a product of the proportional gain P and the voltage error $V_{err}$ and the integral correction may be an integral of a product of the integral gain I and the voltage error $V_{err}$.

In step 186, the control module 40 may adjust the fuel command based on the proportional correction and the integral correction. For example, the control module 40 may adjust the fuel command based on a weighted sum of the proportional correction and the integral correction. More specifically, the fuel command may include control signals for the fuel injectors 24. Control may then return to step 154.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system, comprising:

a saturation determination module that determines when a first exhaust gas oxygen (EGO) sensor is saturated, wherein the first EGO sensor is located upstream from a catalyst;

an adjustment factor generation module that generates an adjustment factor for an integral gain of a fuel control module when the first EGO sensor is saturated; and the fuel control module that adjusts a fuel command for an engine based on differences between expected and measured amounts of oxygen in exhaust gas produced by the engine, a proportional gain, the integral gain, and the integral gain adjustment factor.

2. The engine control system of claim 1, wherein the saturation determination module determines that the first EGO sensor is saturated when measurements from the first EGO sensor are one of greater than a first threshold for a dither period and less than a second threshold for the dither period, and wherein the first threshold is greater than the second threshold.

3. The engine control system of claim 2, further comprising:

a desired equivalence ratio (EQR) determination module that determines a desired EQR based on measurements from a second EGO sensor, intake manifold absolute pressure (MAP), and engine speed, wherein the second EGO sensor is located downstream from the catalyst.

4. The engine control system of claim 3, further comprising:

an expected EGO voltage module that determines expected measurements of the first EGO sensor based on the desired EQR.

5. The engine control system of claim 4, further comprising:

an error determination module that determines an error based on differences between the measurements from the first EGO sensor and the expected measurements from the first EGO sensor.

6. The engine control system of claim 5, further comprising:

a mean expected voltage module that determines a mean expected voltage based on the expected measurements from the first EGO sensor and a predetermined period of time.

7. The engine control system of claim 6, wherein the adjustment factor generation module further includes:

a nominal adjustment factor generation module that generates a nominal integral gain adjustment factor when the first EGO sensor is saturated, wherein the nominal integral gain adjustment factor is based on the mean expected voltage and the first and second thresholds.

8. The engine control system of claim 7, wherein the adjustment factor generation module further includes:

a filter module that filters the nominal integral gain adjustment factor to generate the integral gain adjustment factor, and that sets the integral gain adjustment factor equal to one based on a reset signal.

9. The engine control system of claim 8, wherein the filter module includes a first order discrete filter.

10. The engine control system of claim 8, further comprising:

a reset control module that generates the reset signal when a polarity of the error changes.

11. The engine control system of claim 10, further comprising:

a gain control module that generates the proportional gain and the integral gain, wherein the integral gain includes a product of a baseline integral gain and the integral gain adjustment factor.

12. The engine control system of claim 11, wherein the fuel control module determines the fuel command based on the desired EQR a mass air flow (MAF) into the engine, the error, the proportional gain, the integral gain, and the integral gain adjustment factor.

13. The engine control system of claim 12, wherein the fuel control module determines the fuel command based on the desired EQR, the MAF, a proportional correction that includes a product of the proportional gain and the error, and an integral correction that includes an integral of quantity, wherein the quantity includes a product of the integral gain and the error.

14. The engine control system of claim 13, wherein the fuel control module determines the fuel command based on the desired EQR and a weighted sum of the proportional correction and the integral correction.

15. The engine control system of claim 14, wherein the fuel command includes control signals for fuel injectors of the engine.

16. A method, comprising:

determining when a first exhaust gas oxygen (EGO) sensor is saturated, wherein the first EGO sensor is located upstream from a catalyst;

generating an adjustment factor for an integral gain when the first EGO sensor is saturated; and adjusting a fuel command for an engine based on differences between expected and measured amounts of oxygen in exhaust gas produced by the engine, a proportional gain, the integral gain, and the integral gain adjustment factor.

17. The method of claim 16, further comprising:

determining that the first EGO sensor is saturated when measurements from the first EGO sensor are one of greater than a first threshold for a dither period and less than a second threshold for the dither period, and wherein the first threshold is greater than the second threshold.

18. The method of claim 17, further comprising:

determining a desired equivalence ratio (EQR) based on measurements from a second EGO sensor, intake manifold absolute pressure (MAP), and engine speed, wherein the second EGO sensor is located downstream from the catalyst.

19. The method of claim 18, further comprising:

determining expected measurements of the first EGO sensor based on the desired EQR.

20. The method claim 19, further comprising:

determining an error based on differences between the measurements from the first EGO sensor and the expected measurements from the first EGO sensor.

21. The method of claim 20, further comprising:

determining a mean expected voltage based on the expected measurements from the first EGO sensor and a predetermined period of time.

22. The method of claim 21, further comprising:

generating a nominal integral gain adjustment factor when the first EGO sensor is saturated, wherein the nominal integral gain adjustment factor is based on the mean expected voltage and the first and second thresholds.

23. The method of claim 22, further comprising:

filtering the nominal integral gain adjustment factor to generate the integral gain adjustment factor; and setting the integral gain adjustment factor equal to one based on a reset signal.

24. The method of claim 23, wherein the filtering includes a first order discrete filter.

25. The method of claim 23, further comprising:

generating the reset signal when a polarity of the error changes.

26. The method claim 25, further comprising:

generating the proportional gain and the integral gain, wherein the integral gain includes a product of a baseline integral gain and the integral gain adjustment factor.

27. The method of claim 26, further comprising:

determining the fuel command based on the desired EQR a mass air flow (MAF) into the engine, the error, the proportional gain, the integral gain, and the integral gain adjustment factor.

28. The method of claim 27, further comprising:

determining the fuel command based on the desired EQR, the MAF, a proportional correction that includes a product of the proportional gain and the error, and an integral correction that includes an integral of quantity, wherein the quantity includes a product of the integral gain and the error.

29. The method of claim 28, further comprising:

determining the fuel command based on the desired EQR and a weighted sum of the proportional correction and the integral correction.

30. The method of claim 29, wherein the fuel command includes control signals for fuel injectors of the engine.

* * * * *